US006255763B1

(12) United States Patent
Wright

(10) Patent No.: US 6,255,763 B1
(45) Date of Patent: Jul. 3, 2001

(54) LAMP BASE WITH FLEXIBLE SIDEWALL

(75) Inventor: John O. Wright, York, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 09/416,352

(22) Filed: Oct. 12, 1999

(51) Int. Cl.[7] ..... H01J 5/54; H01J 5/56
(52) U.S. Cl. ..... 313/318.04; 439/615
(58) Field of Search ..... 313/318.09, 318.04, 313/318.01, 316.12; 439/615

(56) References Cited

U.S. PATENT DOCUMENTS 2,336,529 * 12/1943 Cartun ..... 439/615
2,403,137 * 7/1946 Strickland ..... 439/615
4,654,557 * 3/1987 Haraden ..... 313/318.04
4,658,178 * 4/1987 Bradley et al. ..... 313/318.04
5,382,869 * 1/1995 Williamson et al. ..... 313/318.01
6,036,522 * 3/2000 Holzer ..... 439/615

* cited by examiner

*Primary Examiner*—Michael H. Day
(74) *Attorney, Agent, or Firm*—William H. McNeill

(57) ABSTRACT

An insulating member for a base for a light emitting bulb has an electrically insulating body formed from a thermoplastic plastic material and having a first surface, a second surface spaced therefrom, and a sidewall connecting the first and second surfaces. The sidewall is formed to flexibly receive and hold an electrically conductive element, such as the threaded portion of a screw base.

6 Claims, 1 Drawing Sheet

LAMP BASE WITH FLEXIBLE SIDEWALL

TECHNICAL FIELD

This invention relates to electric bulbs and more particularly to bases therefore.

BACKGROUND ART

Electric bulbs, particularly those of the kind employing any of various sizes of Edison bases, i.e., the common threaded base, have a three-part base comprising an electrically conductive eyelet portion and an electrically conductive threaded portion separated and held together by a glass insulator. Such bases are manufactured on automatic equipment, which utilizes a glass furnace for forming the insulator and connecting the separated electrically conductive pieces. These bases are made literally by the billions each year and provide a substantial part of the cost of many light bulbs. The cost of heating and melting the glass, as well as the cost of maintaining the glass furnace contribute to the cost of the bases. Accordingly, it would be an advance in the art if a base could be produced at a lesser cost.

DISCLOSURE OF INVENTION

It is therefore, an object of the invention to obviate the disadvantages of the prior art.

It is yet another object of the invention to enhance the manufacture of bulb bases.

Still another object of the invention is the provision of a new method of making bulb bases.

Yet another object is the elimination of the glass insulator from the base.

These objects are accomplished, in one aspect of the invention by providing an insulating member for a base for a light emitting bulb which comprises an electrically insulating body formed from a thermoplastic plastic material and having a first surface, a second surface spaced therefrom, and a sidewall connecting said first and second surfaces, said sidewall being formed to flexibly receive and hold an electrically conductive element.

In another aspect of the invention, a base for a light emitting bulb comprises an electrically insulating body formed from a thermoplastic plastic material and having a first surface, a second surface spaced therefrom, and a sidewall connecting the first and second surfaces. The sidewall is formed to flexibly receive and hold an electrically conductive element. An electrically conductive eyelet is affixed to the first surface while the electrically conductive element extends beyond the second surface. The electrically conductive element has a first end formed with a reentrant portion having a terminal end in contact with the sidewall.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
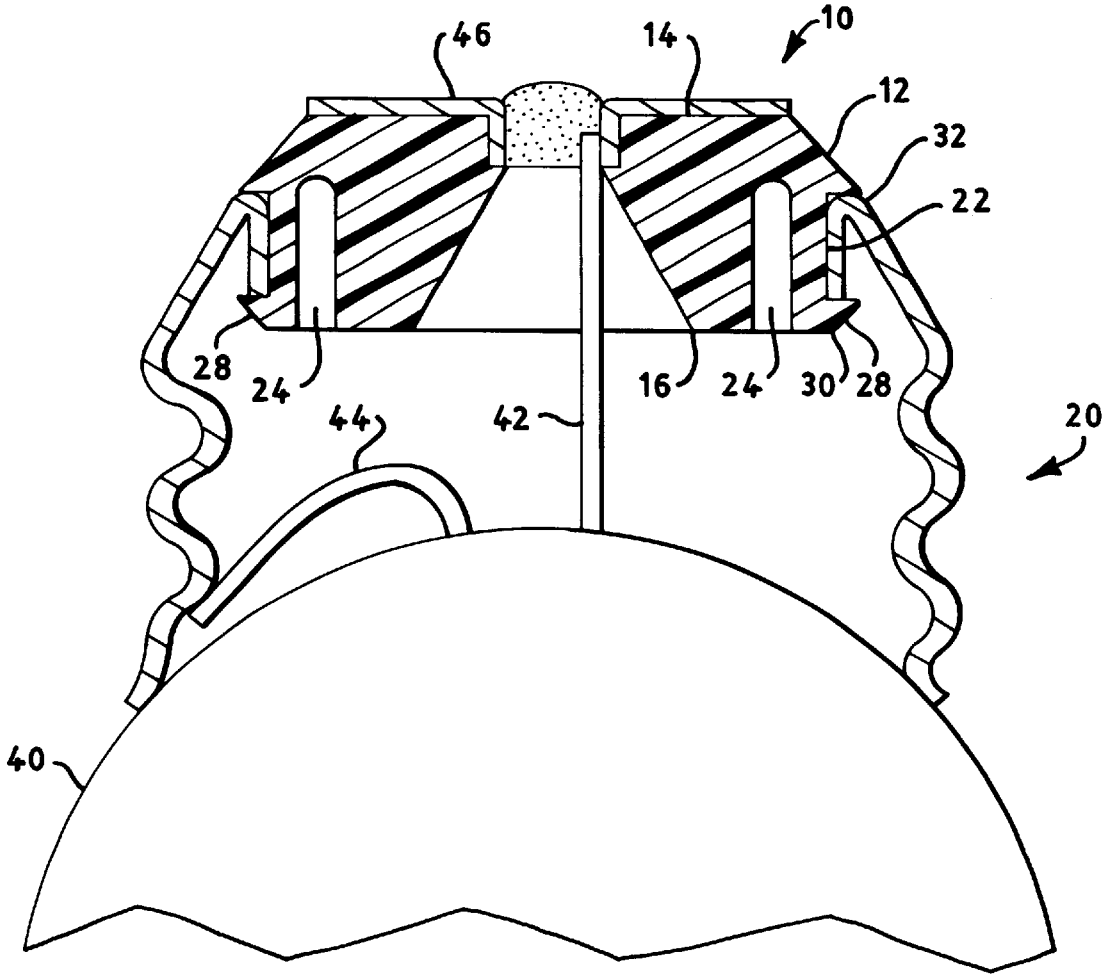
FIG. 1 is an elevational sectional view of an embodiment of the invention.
Figure 2:
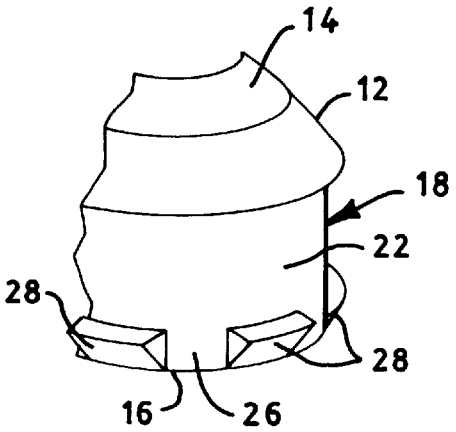
FIG. 2 is an enlarged, perspective view of a portion of the insulating body of the invention.

Referring now to the drawings with greater particularity, there is shown in FIG. 1 a base 10 for a light emitting bulb that comprises an electrically insulating body 12 formed from a thermoplastic plastic material, for example, polyethylene, and having a first surface 14, a second surface 16 spaced therefrom, and a sidewall 18 (see FIG. 2) separating and connecting the first and second surfaces. The sidewall is formed to flexibly receive and hold an electrically conductive element 20, which can be the threaded portion of a screw base. The flexible portion comprises a groove 22 on the outside of sidewall 18 and a channel 24 formed in second surface 16. The groove 22 and channel 24 cooperate with alternating slots 26 and retention protuberances 28 that are formed on a free surface 30 of receiving groove 22.

Figure 3:
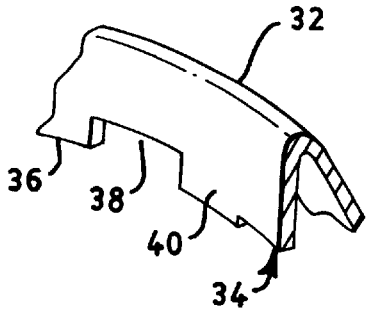
FIG. 3 is a perspective view of the terminal end of the electrically conductive element.

Electrically conductive element 20 (see particularly, FIG. 3) has a reentrant portion 32 having a terminal end 34 that fits into receiving groove 22. The edge 36 of terminal end 34 is provided with slots and ribs 38, 40, respectively, that cooperate with the retention protuberances and slots 28 and 26 that are formed on the free surface 30. This not only locks the element 20 onto the insulating body 12 but also prevents rotation of the element 20 with respect to the body 12.

The now completed base can be assembled to a bulb 40 containing a light emitting element such as an incandescent filament, an arc tube, a light emitting diode array, an electroluminescent display or other device. In the case of a bulb containing an incandescent filament, at least two lead-in wires 42 and 44 exit the bulb 40 and are attached, respectively, to an eyelet 46 affixed to the first surface 14 and the element 20.

Thus there is provided a new base for a light emitting bulb that is economical to manufacture , primarily due to the elimination of the glass insulator and its glass-melting furnace.

While there have been shown and described what are at present considered to be the preferred embodiments of the invention, it will be apparent to those skilled in the art that various changes and modification can be made herein without departing from the scope of the invention as defined by the appended claims.

What is claimed is:

1. An insulating member for a base for light emitting bulb comprising: an electrically insulating body formed from a thermoplastic plastic material and having a first surface, a second surface spaced therefrom, and a sidewall connecting said first and second surfaces, said sidewall being formed to flexibly receive and hold an electrically conductive element.

2. The insulating member of claim 1 wherein said sidewall has an electrically conductive element receiving groove formed therein.

3. The insulating member of claim 2 wherein said second surface has a circumferential channel formed therein.

4. The insulation member of claim 3 wherein a free surface of said receiving groove is formed to provide alternating slots and retention protuberances.

5. A base for a light emitting bulb comprising: an insulating member in accordance with claim 2; an electrically conductive eyelet affixed to said first surface; and an electrically conductive element extending beyond said second surface, said electrically conductive element having a first end formed with a reentrant portion having a terminal end in contact with said sidewall.

6. The base of claim 5 wherein said terminal end is formed with alternating slots and ribs which cooperate with slots and retention protuberances formed on said receiving groove.

* * * * *